US008112938B2

(12) United States Patent
Bolduc et al.

(10) Patent No.: US 8,112,938 B2
(45) Date of Patent: Feb. 14, 2012

(54) GATE SYSTEM WITH AUTOMATIC LOCKING AND UNLOCKING FEATURE

(75) Inventors: René Bolduc, Sainte-Clotilde-de-Beauce (CA); Yvan Mercier, Sainte-Clotilde-de-Beauce (CA)

(73) Assignee: Les Ateliers Bolduc et Freres Inc., Ste-Clotilde-de-Beauce, Quebec (CA)

( * ) Notice: Subject to any disclaimer, the term of this patent is extended or adjusted under 35 U.S.C. 154(b) by 362 days.

(21) Appl. No.: 12/471,440

(22) Filed: May 25, 2009

(65) Prior Publication Data

US 2010/0293855 A1 Nov. 25, 2010

(51) Int. Cl.
*E05F 15/20* (2006.01)

(52) U.S. Cl. ..... 49/49; 49/25; 49/141; 49/334

(58) Field of Classification Search ..... 49/13, 25, 49/31, 49, 68

See application file for complete search history.

(56) References Cited

U.S. PATENT DOCUMENTS

| | | | | | |
|---|---|---|---|---|---|
| 3,386,202 | A * | 6/1968 | Crews et al. | 49/35 |
| 3,478,467 | A * | 11/1969 | May | 49/35 |
| 3,606,698 | A * | 9/1971 | Tanaka et al. | 49/35 |
| 3,742,647 | A * | 7/1973 | Tomita | 49/35 |
| 4,155,199 | A * | 5/1979 | Rubertus | 49/141 |
| 4,290,230 | A * | 9/1981 | t'Kint de Roodenbeke | 49/49 |
| 4,472,908 | A * | 9/1984 | Wanzl et al. | 49/25 |
| 4,851,746 | A * | 7/1989 | Milke | 318/467 |
| 5,212,909 | A * | 5/1993 | Morin | 49/49 |
| 5,333,410 | A * | 8/1994 | Tetherton | 49/35 |
| 5,615,520 | A * | 4/1997 | McGuire | 49/237 |
| 6,185,867 | B1 * | 2/2001 | McGuire | 49/109 |
| 7,013,531 | B2 * | 3/2006 | Jackson | 16/309 |
| 7,155,779 | B2 * | 1/2007 | Watkins | 16/316 |
| 2002/0116788 | A1 * | 8/2002 | Pompei | 16/315 |
| 2006/0101716 | A1 * | 5/2006 | Vandyck et al. | 49/35 |
| 2007/0107477 | A1 * | 5/2007 | Fawcett et al. | 70/57.1 |
| 2007/0271846 | A1 * | 11/2007 | Miller et al. | 49/49 |
| 2009/0090063 | A1 * | 4/2009 | Kucer et al. | 49/104 |
| 2009/0119995 | A1 * | 5/2009 | Kucer et al. | 49/31 |
| 2010/0031573 | A1 * | 2/2010 | Whiting et al. | 49/31 |

* cited by examiner

*Primary Examiner* — Katherine Mitchell
*Assistant Examiner* — Justin Rephann
(74) *Attorney, Agent, or Firm* — Norton Rose Canada LLP

(57) ABSTRACT

A controlled gate system is comprised of a barrier arm which is pivotally connected to a first fixed support. A motion detector is secured to a second fixed support spaced a predetermined distance from the first fixed support and in alignment therewith to create a restricted passageway with the barrier arm normally resting in an obstructing position within the passageway. The barrier arm is arrested at the obstructing position by a solenoid actuated latch which is disengaged by the motion detector. The arc of displacement of the barrier arm is also restricted to permit passage through the passageway in a single direction. Under certain conditions a controller will permit the barrier arm to be disengaged to permit passage in the passageway in opposed directions. The motion detector of the preferred embodiment is constituted by a further barrier arm.

23 Claims, 11 Drawing Sheets

GATE SYSTEM WITH AUTOMATIC LOCKING AND UNLOCKING FEATURE

TECHNICAL FIELD

The present invention relates to a controlled gate system with automatic locking and unlocking feature and particularly, but not exclusively, for use in shopping establishments.

BACKGROUND ART

A multitude of gate systems are known whereby to restrict passage or control the passage of people in specific areas. Some of these systems are in the form of complicated barriers or turnstile systems or simply a single arm which is pivotally connected at one end by a pivoting mechanism permitting passage in a single direction. An example of such single arm systems is disclosed in U.S. Pat. No. 5,561,520. Many of these systems are complex in design and are therefore subject to wear and breakage and require frequent maintenance. This can be a nuisance particularly if such gates become broken and locked preventing a person from entering into an establishment such as a supermarket.

Another disadvantage of known prior art one-way self-closing gates is that many of these gates permit passage in only a single direction and in an emergency situation it is not possible or very difficult to exit an establishment through these barriers. Another disadvantage of some of these entrance gate systems is that they do not provide alarms if they are misused such as person trying to exit therethrough and therefore require periodic surveyance. Still further, some of these entrance gate systems permit easy undetected exit therethrough by a person maintaining the barriers or a pair of barriers in a double-gate system, in an open position for a long period of time permitting exit therethrough of another person and even the passage of shopping carts.

SUMMARY OF INVENTION

It is therefore a feature of the present invention to provide an entrance gate system which substantially overcomes the above-mentioned disadvantages of the prior art.

Another feature of the present invention is to provide a controlled gate system which is simple in construction and which provides for controlled passage therethrough in a single direction or in opposed directions during alarm conditions or during other conditions when necessary to do so by personnel of an establishment where the entrance gate system is provided.

Another feature of the present invention is to provide a controlled gate system having an automatic locking and unlocking feature.

Another feature of the present invention is to provide a controlled gate system equipped with audible and visual alarms to regulate the passage of people through the entrance gate system and to indicate abnormal conditions.

Another feature of the present invention is to provide a controlled gate system having a controller which is interfaced with a general alarm system of an establishment to permit passage in opposed directions during certain alarm conditions.

According to the above features, from a broad aspect, the present invention provides a controlled gate system comprising a barrier arm pivotally connected to a first fixed support. Motion detection means is secured to a second fixed support spaced a predetermined distance from the first fixed support and in alignment therewith to create a restricted passageway with the barrier arm normally resting in an obstructing position within the passageway. Arresting means is provided for arresting the barrier arm at the obstructing position. Control means is provided to position the arresting means at an engaged or disengaged position to arrest or release the barrier arm from pivotal movement. Stopper means is provided to restrict the arc of displacement of the barrier arm from the obstructing position to a non-obstructing position to permit passage through the passageway in a single direction when the arresting means is at the disengaged position.

According to a further broad aspect of the present invention the motion detection means is constituted by a second barrier arm having a sensing means associated therewith to sense the displacement of the second barrier arm in the direction of the passageway whereby to disable the arresting means to permit both barrier arms to be pivoted in an open direction for the passage through the passageway and within a predetermined time period after which an alarm condition is sound.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
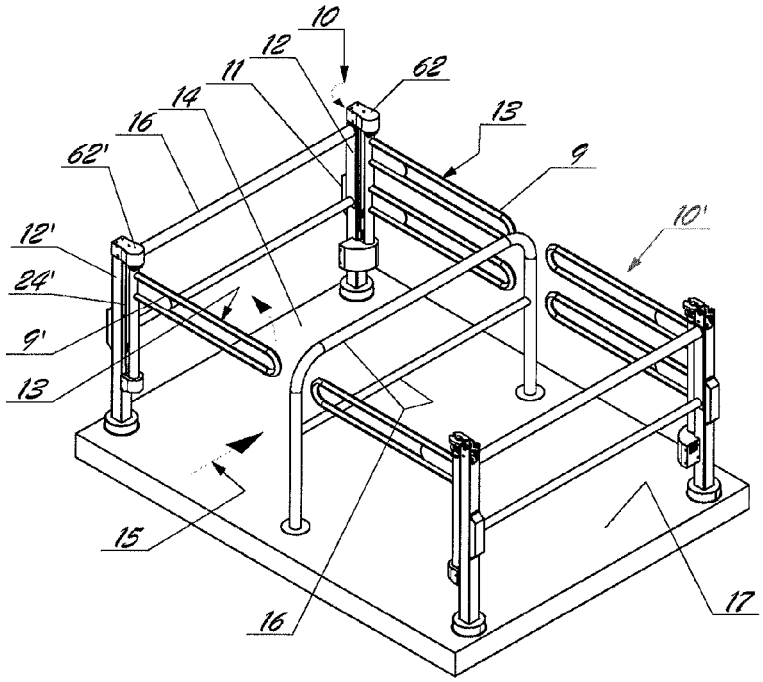
FIG. 1 is a perspective view illustrating a double-gate system constructed in accordance with the present invention and having two spaced-apart barrier arms secured at a predetermined distance therebetween to create a restricted passageway with other barrier rods.

Referring now to the drawings and more particularly to FIG. 1, there is shown generally at 10 a gate system constructed in accordance with the present invention. The gate system will be referred to herein as an entrance gate system to an establishment, but it may also be used in other applications. As hereinshown there are two entrance gate systems 10 and 10' secured in a side-by-side position. Only one of these systems will be described herein as these are constructed in an identical manner. The entrance gate system 10 is comprised of a first fixed support 11, herein in the form of a support column 12 to which a barrier arm assembly 13 is pivotally connected. A motion detection means which is hereinshown in the form of a second support column 12' is secured at a predetermined distance from the first support column 12 and it is provided with a motion detection means which is herein illustrated in the form of a second barrier arm assembly 13'. It is also envisaged that the second support column 12 may be any other type of support in which a motion detector may be secured to detect the passage of a person entering the entrance gate system 10 of the present invention. The support columns 12 and 12' are secured in side alignment and create a restricted passageway 14 to permit the passage of people in the direction of arrow 15 from the outer support column 12' to the inner support column 12.

As hereinshown the barrier arm assemblies 13 and 13' normally rest in an obstructing position across the passageway 14, herein transversely at substantially 90° therein.

As also shown in FIG. 1 and conventional with these passageways, tubular barrier rods 16 are conveniently secured with respect to the support columns to provide a restricted passageway. All of the columns and barrier rods are rigidly anchored to the floor 17 of an establishment to permit one-way restricted passage.

Figure 2:
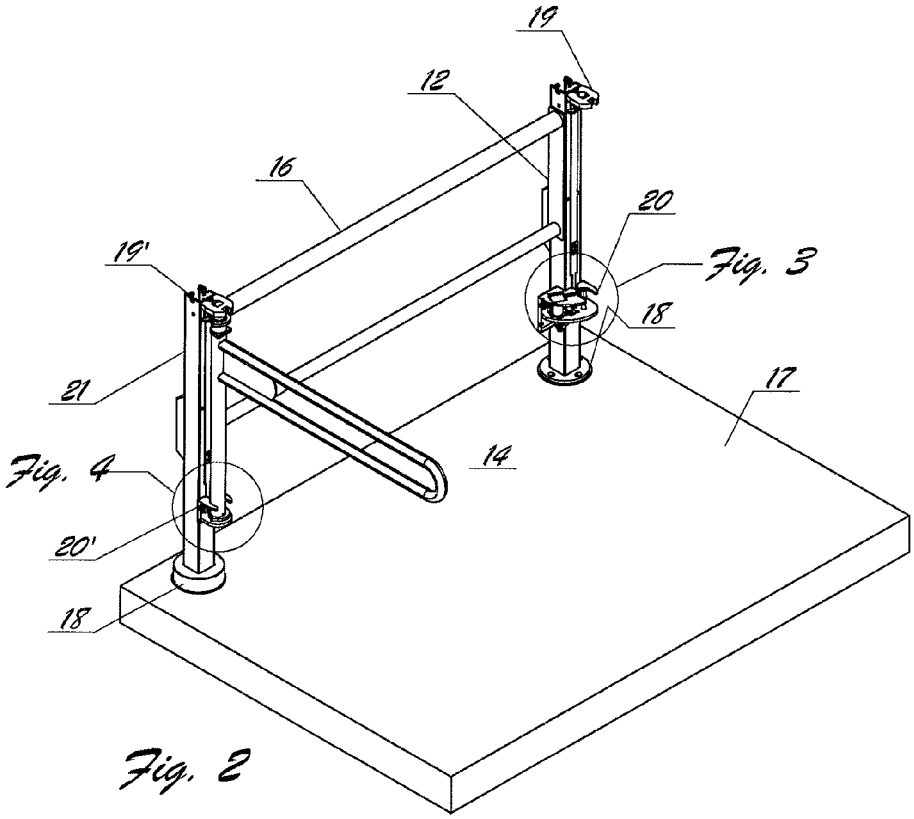
FIG. 2 is a perspective view showing the construction of the fixed supports to which the two barrier arms are pivotally connectable, only one barrier arm herein shown assembled to one of the posts.

With additional reference now to FIGS. 2 to 11B, there will be described the construction and operation of the barrier arm assemblies 13 and 13' and their securement to their support columns 12 and 12'. As shown in FIG. 2, the inner support column 12 and outer support column 12' are hollow vertical support tubes each having a securement base 18 to be anchored into the floor 17. These support columns 12 and 12' are provided with a top support bracket 19 and 19', respectively and bottom support brackets 20 and 20' respectively. The bottom support bracket 20 of the inner support column 12 is of different construction than the bottom support bracket 20' of the outer support column 12' as better illustrated in FIGS. 3, 5 and 6.

Figure 3:
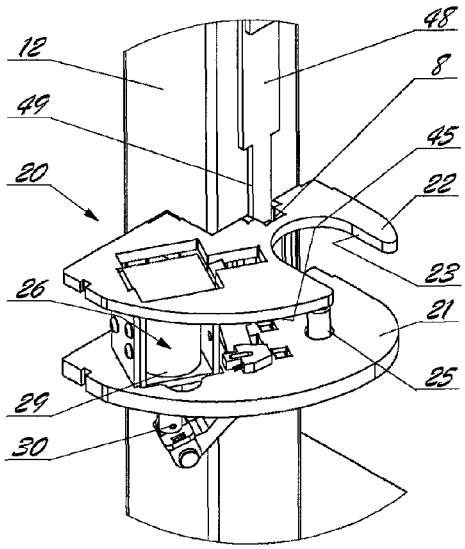
FIG. 3 is an enlarged perspective view of the bottom support bracket as identified by the circle portion of FIG. 2, identified with the designation "FIG. 3", and associated with the inner support column of the entrance gate system.
Figure 5:
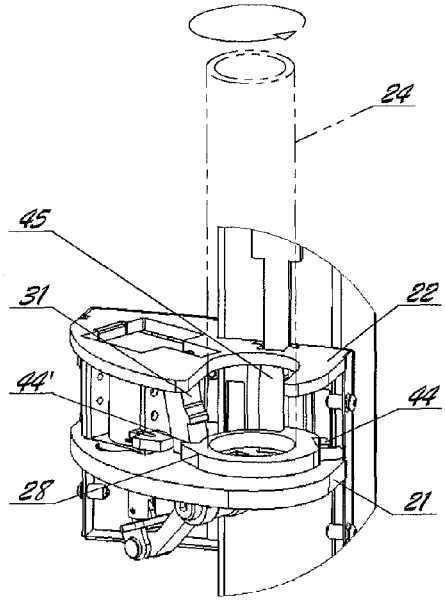
Figure 6:
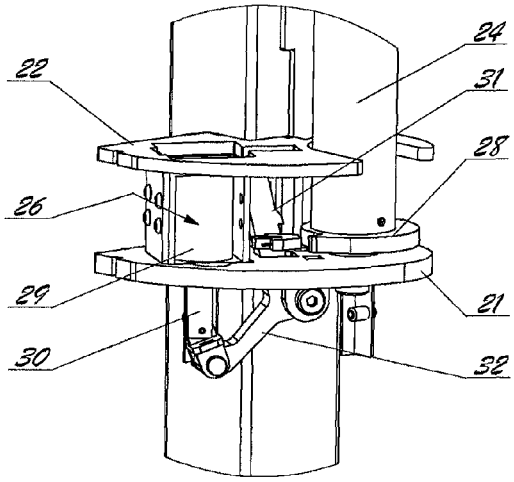
FIG. 6 is a further perspective view showing the arresting latch in a disengaged position.

As shown in FIGS. 3, 5 and 6, the bottom support bracket 20 of the inner column 12 is provided with two spaced-apart horizontal support walls, namely a bottom support wall 21 and an upper support guide wall 22. The upper support guide wall 22 is provided with a U-shaped slot 23 to receive a lower end portion of a vertical tubular support member 24 (see FIG. 6), forming part of the barrier arm assembly 13 and in close guided fit therein. A passage 8 permits passage of a stopper element 45 to a non-engaging position. A hole 25 is provided in the bottom support wall 21 and aligned centrally with the U-shaped slot 23 whereby to secure the lower end of a stationary vertical shaft 35 disposed within the tubular support member 24, as will be later described.

Figure 8:
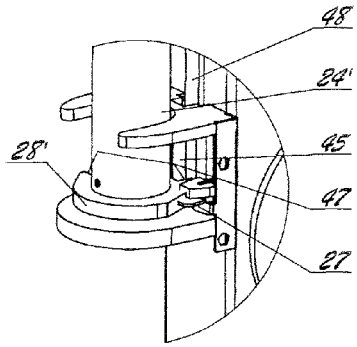
FIG. 8 is a perspective view of a bottom portion of the vertical tubular support member of FIG. 7 showing the relationship of the stopper ring with respect to the stopper element.

Secured to the bottom support wall 21 is a solenoid 26 which is operated by a signal received from a sensor 27, as shown in FIG. 8, which detects the displacement of a stopper ring 28 secured to the bottom end of the vertical tubular support member 24, as shown in FIG. 6. The solenoid 26 is provided with an energizable coil 29 which actuates a solenoid rod 30 connected to an arresting latch 31 through a pivotal linkage 32 whereby to position the arresting latch 31 at an engaged obstructing position with respect to the stopper ring 28, as shown in FIG. 5, and at a disengaged, non-obstructing position as shown in FIG. 6. The solenoid 26 actuated latch 31 constitutes a displaceable arresting means to arrest the barrier arms 9 of the barrier arm assembly 13 at the obstructing position within the passageway 14.

Figure 4:
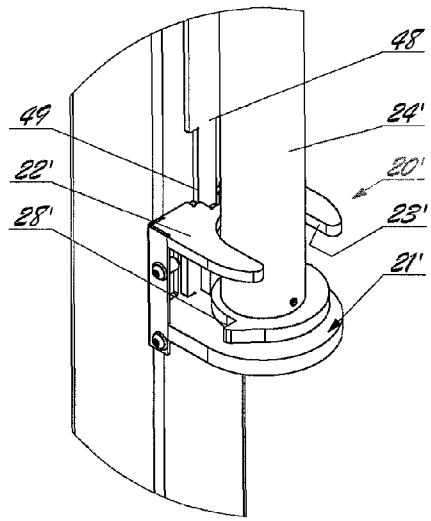
FIG. 4 is an enlarged view of the circle portion of FIG. 2, identified by the designation "FIG. 4", and associated with the outer support column of the entrance gate system.

The bottom support bracket 20' of the outer support column 12', as shown in FIG. 4, is not equipped with a solenoid and latch and it supports the bottom end of the vertical tubular support member 24' of the second barrier arm assembly 13' for rotation from an obstructing position as shown in FIG. 1 to an open position inwardly of the passageway in the direction of arrow 15 and displaceable substantially 90° therewithin to permit free access to the passageway 14. The bracket 20' also has a bottom support wall 21' and an upper support wall 22' provided with a U-shaped slot 23' to receive the vertical tubular support member 24' as shown in FIG. 4. The vertical tubular support member 24' is also provided with a stopper ring 28' but constructed differently as will be described further on.

Figure 7:
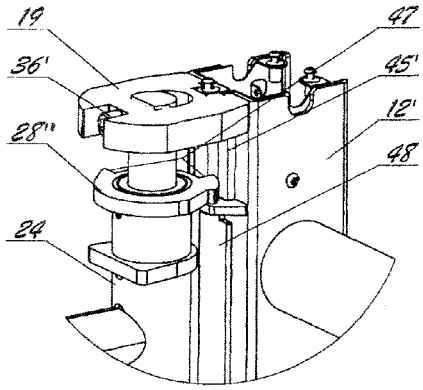
FIG. 7 is a perspective view showing the top end of the vertical tubular support member of the barrier arm with a further stopper ring secured thereto and in line with a stopper element to restrict the rotational movement of the vertical tubular support member.
Figure 9:
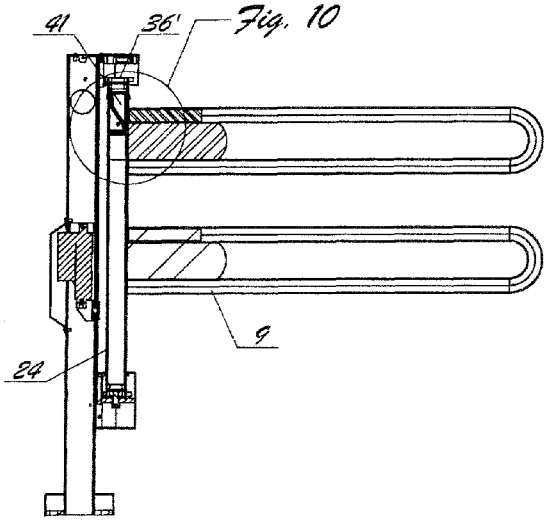
FIG. 9 is a section view showing the construction of the barrier arm and its vertical tubular support member and having a ramp follower member with a sloped formation secured therein.
Figure 10:
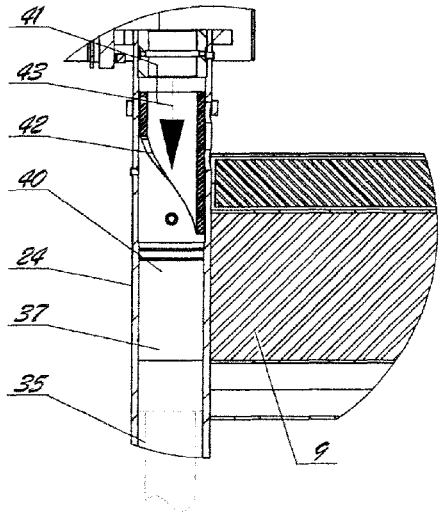
FIG. 10 is an enlarged view of the circle portion "C" of FIG. 9 showing the relationship of the sloped formation with respect to a stationary ramp formation secured to a stationary vertical shaft held captive between the brackets of the support columns.
Figure 11B:
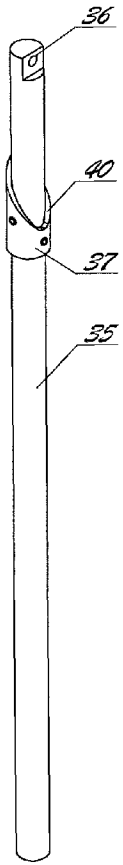
FIG. 11B is a perspective view of the vertical shaft showing the construction features of the stationary ramp formation.
Figure 11A:
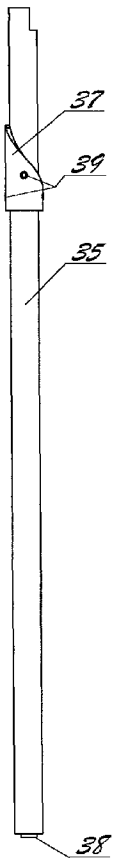
FIG. 11A is a side view of the vertical shaft.

Referring now to FIGS. 9 to 11B, there is shown the construction of the barrier arm assemblies 13 or 13'. The assemblies each comprise a stationary vertical shaft 35 which is of rod shape as shown in FIG. 11B and having a threaded bore 36 at a top end thereof for receiving a fastener 36' therein, see FIGS. 7 and 9, to secure the top ends of the shafts 35 immovable in their respective top support brackets 19 and 19'. The bottom end has a connecting rod 38 which is positioned in the hole 25 in the bottom support walls 21 and 21' of the support bracket 19, as shown in FIG. 7 whereby to secure the shafts 35 immovable in a vertical position. The stationary vertical shaft 35 is further provided with an upwardly angulated stationary ramp formation 37 spaced from an upper end 38 of the stationary vertical shaft 35 and secured to the shaft by fasteners 39. As shown in FIG. 11B, the stationary ramp formation 37 has opposed angularly shaped engageable guide surfaces 40.

Referring now to FIGS. 9 and 10, it can be seen that the vertical tubular support member 24 is provided at an upper end thereof with a ramp follower member 41 and as shown in FIG. 10, the vertical tubular support member 24 is adapted to be positioned over the stationary vertical shaft 35 in the direction of arrow 43 and not yet in full position wherein the slope formation 42 rests on the engageable guide surfaces 40 of the stationary ramp formation 37. Accordingly, when the barrier arm 9 is displaced from its obstructing position, as shown in FIG. 1, towards a non-obstructing position by a pushing force, the ramp follower slope formation 42 is caused to be displaced upwardly by its frictional contact with the upwardly angulated stationary ramp formation 37 causing the vertical tubular support member 24 and the barrier arm 9 to move away from its obstructing position and rise as it is displaced from its obstructing position towards an open position. When the pushing force is released on the barrier arm the ramp follower member 41 will cause the vertical tubular support member 24 to descend by gravity over the stationary vertical support shaft 35 with the barrier arm 9 re-establishing its obstructing transverse position. Accordingly, the vertical tubular member 24 is axially rotatably supported over the stationary vertical shaft 35.

With reference now more specifically to FIGS. 5 to 8, there is shown the construction of stopper means whereby to arrest the displacement of the barrier arms from their normally obstructing position, as shown in FIG. 1, to an open position in the direction of arrow 15. As previously described, stopper rings 28 and 28' are secured to the bottom end of the vertical tubular support members 24 and 24', respectively, of the barrier arm assemblies 13 and 13'. The stopper ring 28 is provided with two spaced-apart abutment surfaces 44 and 44' disposed at 1800 from one another, see FIG. 5. A stopper member 45, see FIGS. 3 and 5, is positioned against the support column 12 and disposed for abutting engagement by the abutment surface 44 when the vertical tubular support member with the stopper ring 28 is rotated in the direction of arrow 15, as shown in FIG. 1, to restrict the position of the barrier arm 9 to an open angle of 90° with respect to the vertical support column 12. Similarly, as shown in FIG. 7, a further stopper ring 28" is secured adjacent the upper end of the vertical tubular support member 24 but it has abutment surfaces 47 which are herein disposed at 90° angles from one another. The reason for this is that the abutment surface 40' of the lower stopper ring 28 is disposed for abutment with the arresting latch 31 of the solenoid 26 when in an engaged position to arrest the opening of the barrier arm assembly 13 or more to arrest the rotation of the stopper ring 28 in the direction of arrow 46. The upper ring 28" will only permit 90° rotation of the vertical tubular support member due to the position of its abutment surfaces 47 engaging either side of an upper stopper member 45'.

As shown in FIG. 8, the bottom stopper ring 28' of the vertical tubular support member 24' of the second or outer barrier arm assembly 13' is constructed identically with the upper stopper ring 28" which is also provided at the upper end of its vertical tubular support member 24'.

Figure 14:
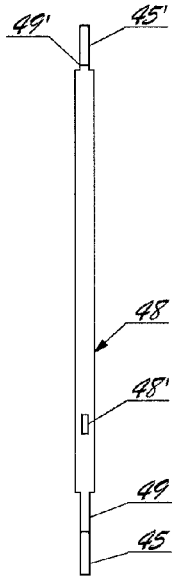
FIG. 14 is a front view of the displaceable support rod shown in FIG. 12B.
Figure 15:
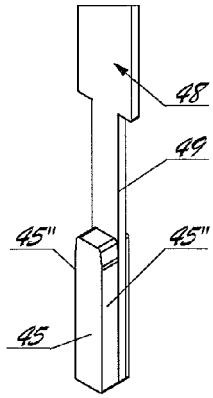
FIG. 15 is an enlarged perspective view of the bottom end of the displaceable support rod shown in FIG. 14.
Figure 16:
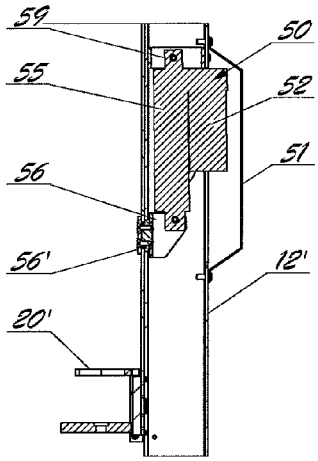
FIG. 16 is an enlarged section view showing the connection of the actuator in the support column and its connection to the displaceable support rod outside the column.

Referring to FIGS. 3, 4, 14 and 15, it can be seen that the stopper members 45 and 45' are secured at opposed ends of a displaceable support rod 48 which is a flat metal rod having opposed narrower extensions 49, herein a bottom extension 49 which is longer than an upper extension 49', see FIG. 14, and on which the stopper members, herein rectangular metal blocks having opposed parallel vertical arresting surfaces 45" are immovably secured. The reason for the narrow extension 49 being longer is that the bottom support brackets 21 are double-wall brackets needing a longer extension as the displaceable support rod is axially displaceable whereby to position the stopper member 45 at an engaged position, as shown in FIGS. 3 and 5, and at a disengaged position wherein the stopper members are disposed through the top wall 22 and top wall 19 of the lower and upper support brackets 20 and 25, to provide free axial rotation of the vertical tubular support member 24 and 24' in emergency situations or when desired. The stopper rings of the tubular support members 24 and 24' prevent the barrier arms 9 and 9' from being pivotally displaced outwards in a direction opposite arrow 15 shown in FIG. 1.

Figure 12C:
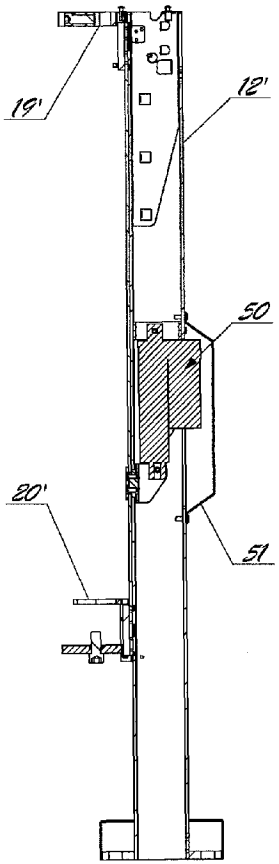
FIG. 12C is a section view along section line D-D of FIG. 12B showing the position of the actuator within the outer support column.
Figure 12B:
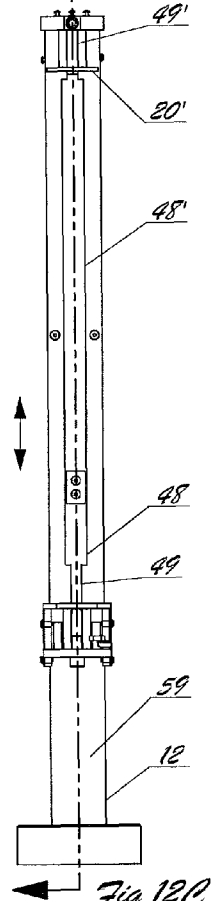
FIG. 12B is a front view of FIG. 12A illustrating the shape and location of the displaceable support rod to which the stopper elements are connected and displaceable.
Figure 12A:
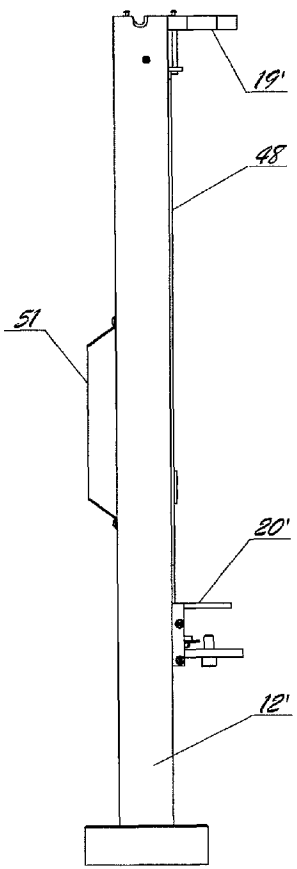
FIG. 12A is a side view of the outer support column showing the position of the actuator housing.
Figure 13:
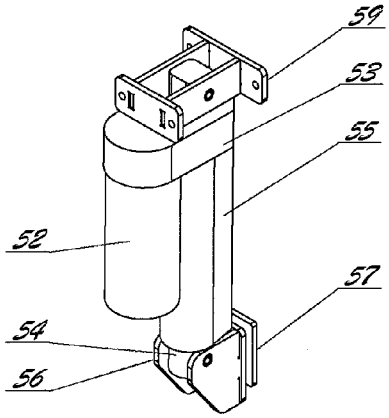
FIG. 13 is a perspective view of the actuator and its attachment brackets.
Figure 17:
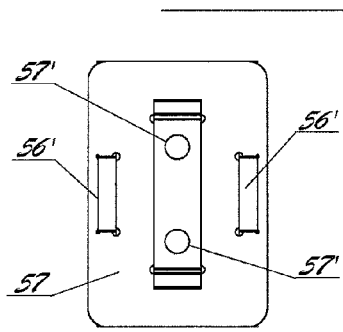
FIG. 17 is a perspective view of the rod retention plate secured to the attachment bracket secured to the end of the displaceable arm of the actuator.
Figure 18:
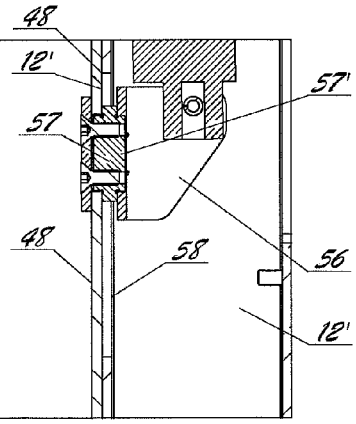
FIG. 18 is an enlarged view showing the interconnection of the attachment bracket with the displaceable support rod.

With reference now to FIGS. 12A to 12C, it can be seen that the tubular support columns 12 and 12' are each provided with displaceable vertical support rods 48 and 48', respectively, as previously described, on a face thereof facing the direction of the brackets, herein support brackets 20' and 19' of column 12'. Each displaceable support rod 48 and 48' is connected to a respective actuator 50 which is housed within the columns 12 and 12' in the actuator housings 51, as shown in FIGS. 12A and 12C. The actuator construction is illustrated in FIG. 13. The purpose of the actuators 50 is to displace the stopper members 45 and 45' from their engaging position with the stopper rings 28 and 28' in emergency situations. The actuators 50 have an electric motor 52 coupled to gearing or other type of drive (not shown) housed within the housing 53 to cause a displaceable arm 54 to move in and out of the arm housing 55. With further reference to FIGS. 17 and 18, the displaceable arm 54 has an attachment bracket 56 at a free end thereof for securement to an attaching plate 57 which is secured to the support rod 48 through the hole 48', see FIG. 14. Fasteners 57' secure the plate 57 to the bracket 56. A spacer block 57' extends through openings 56' of the plate 57 to connect thereto. The spacer block 57' moves within a slot 58 provided in the front face 59 of the support column 12', see FIG. 18, to cause the displaceable support rod 48 to move up and down in a guided fashion. The slot 58 is sufficiently long whereby to position the stopper members 45 and 45' in a non-engaging position above their respective stopper rings to free the tubular support members 24 and 24'.

Figure 19:
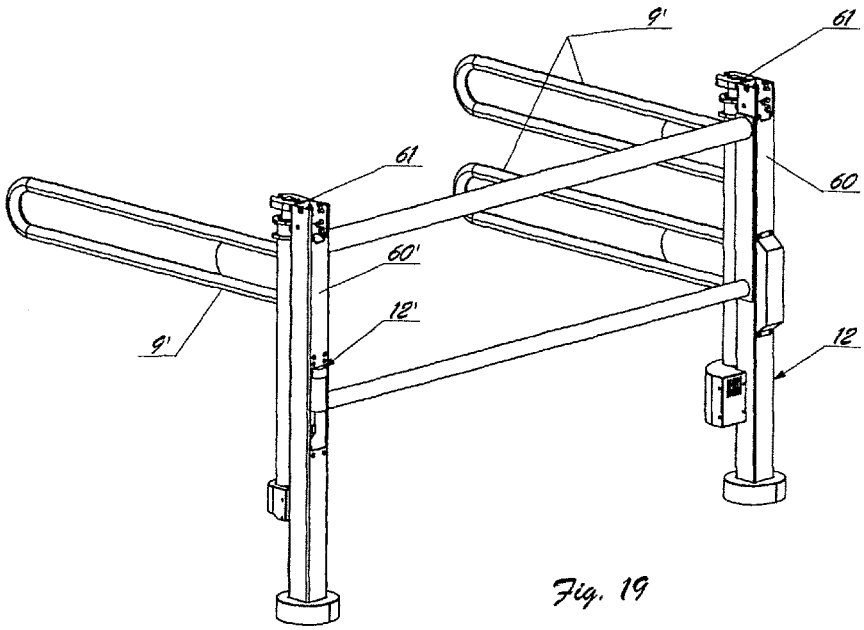
FIG. 19 is a perspective rear view of the entrance gate system of the present invention and partly fragmented to show the securement of the actuator and other controller elements within the support columns.

FIG. 19 shows the construction of the support columns 12 and 12' and as hereinshown these columns are substantially of square cross-section but could also be of different cross-section. The back walls 60 and 60' of these columns have removable section(s) whereby to secure the actuators 50, wiring, etc. As shown in FIG. 13, the actuator is provided with an attachment bracket 59 at an upper end thereof to removably secure same in its respective support columns 12 and 12'. A control circuit is also provided in the upper ends of the inner support column 12 on a suitable support 61 (see FIG. 19) and the top end of this support is provided with signaling means in the form of flashing LED lights and audible sound generating means to generate an alarm under alarm conditions as will be described later. Of course, both the inner and outer support columns 12 and 12' could be provided with these alarm generating means which are obvious to a person skilled in the art.

Figure 20:
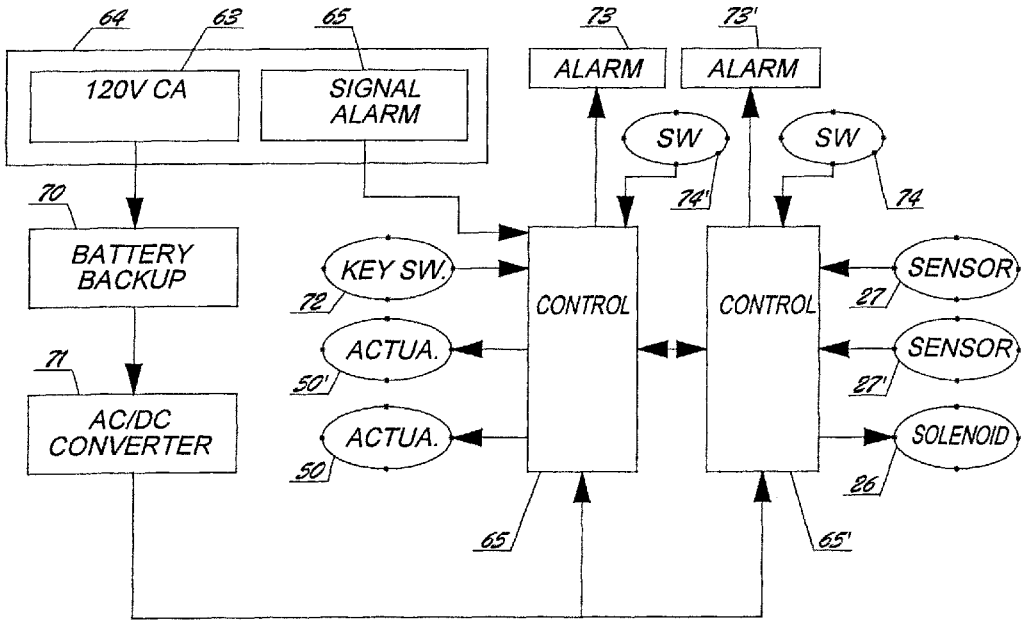
FIG. 20 is a block diagram showing the interrelationship between the controller and associated devices of the entrance gate system as well as with local power supplies and general alarm systems provided by an establishment in which the entrance gate system is secured.

With reference now to FIG. 20, there is shown a block diagram of the control means constituted by two controller modules 65 and 65', one in each column, and their associated devices. The controller assemblies are concealed in the posts and the posts are provided with caps 62 and 62' to prevent tampering. These caps and/or columns are provided with openings to render the visual and audible alarms effective.

FIG. 20 is a simplified schematic diagram of the wiring system and devices associated with the controller modules 65 and 65'. Controller module 65 is positioned within the inner support column 12 and controller module 65' within the outer support column 12'. These controllers are provided with a power supply from a 120 volt outlet 63 of an establishment 64 where the entrance gate system 10 is installed. A DC voltage is supplied through an AC to DC converter 71 to provide a 12-volt DC supply to the controllers 65 and 65'. A battery back-up 70 is also provided in case of power failure. These establishments also have fire alarm systems 65 and an output connection 66 therefrom is also fed to the controllers 65 and 65' whereby the controllers actuate the actuators 50 and 50' when a specific alarm condition is detected to release the barrier arms from engagement. A programmable timer circuit, not shown, is also associated with the controller 65' to set the time delay for normal passage in the passageway. Optical sensor 27, as shown in FIG. 8, provides signals to the controller 65. Another sensor 27', associated with the inner support column 12, also provides a signal to the controller 65' to indicate the position of the inner barrier arm 9. As hereinshown the solenoid 26 is also controlled by the controller 65'.

As shown in FIG. 20, a key switch connection 72 is provided to cause the controllers to actuate the actuators 50 and 50' whereby to position the stopper elements to a non-engageable position whereby to free the barrier arms of both the inner and outer support columns whereby they can pivot in either direction from their normal obstructing position. As also herein illustrated both inner and outer support columns 12 and 12' are provided with audible and/or visual alarms 73 and 73'. Sensor switches 74 and 74' are conveniently located in their respective support columns whereby to sense the position of the stopper elements 45, and namely the displaceable support rod 48 and provide signals to their respective controllers 65 and 65'. As previously mentioned, a timer circuit, not shown, is a programmable timer circuit and is adjustable whereby to adjust the time delay for the passage of persons within the passageway 14 in the direction 15 as shown in FIG. 1.

The entire system can be de-activated by the use of a key operated switch 72 or remotely through the alarm system of the establishment thereby permitting people to exit through the entrance gate system in case of fire or other such major emergencies. If the system is disengaged by use of a key it needs to be re-engaged by the key. Key slots, not shown, are provided on both of the support columns. If the system is disengaged by an alarm condition, there is provided a reset button on a supply panel to re-activate the system.

Figure 21:
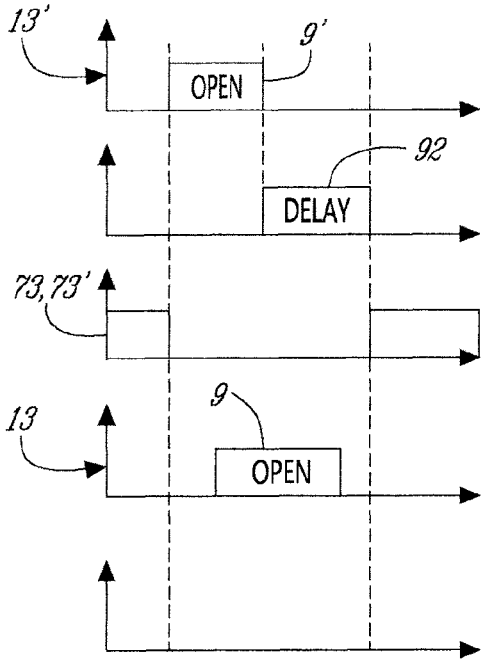
FIGS. 21 to 25 are time-flow diagrams illustrating the operation of the entrance gate system under different conditions.

As shown in FIG. 21, if the barrier arm 9' is pushed in the direction of arrow 15, this automatically disengages the alarm systems 73 and 73' and disengages the solenoid arresting latch 31 of the barrier arm 9. When the barrier arm 9' returns to its arresting position, as shown in FIG. 1, with a person now having entered the passageway 14, the timer starts counting a programmed time lapse 92 while the person exits through the second barrier arm 9. The system re-arms itself once the time delay 92 has expired. The time delay 92 is adjustable in the program. The barrier arm assembly 13 also cannot activate the alarms 73 and 73' if the barrier arm 9 is opened and closed during the time delay. The alarms 73 and 73' are automatically re-armed after the time delay. The diagram of FIG. 21 illustrates this normal sequence of operation.

Figure 22:
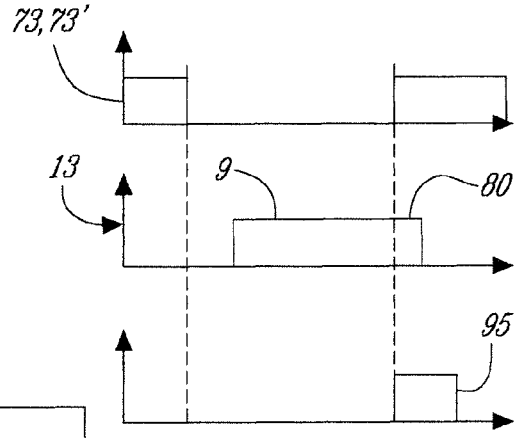
Figure 23:
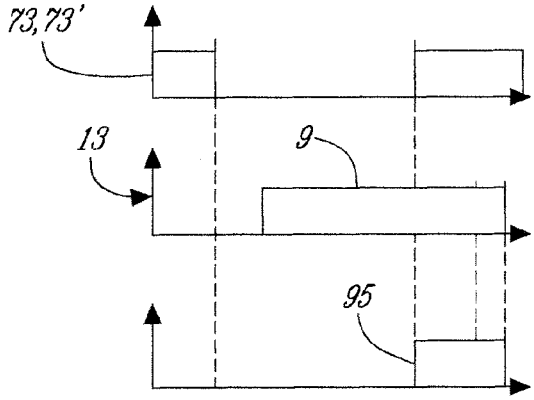

Referring now to FIGS. 22 and 23, there are illustrated alarm conditions. As shown in FIG. 22, if the barrier arm 9 of the inner barrier arm assembly 13 remains open when the system is armed, this being shown by the block extension 80, the alarm circuits are armed and this triggers a visual and/or audible alarm, as shown by block 95, provided in the support columns. This alarm 95 will stay on as long as the barrier arm 9 remains open, that is to say until it returns to its obstructing position. Such is illustrated in FIG. 23.

Figure 24:
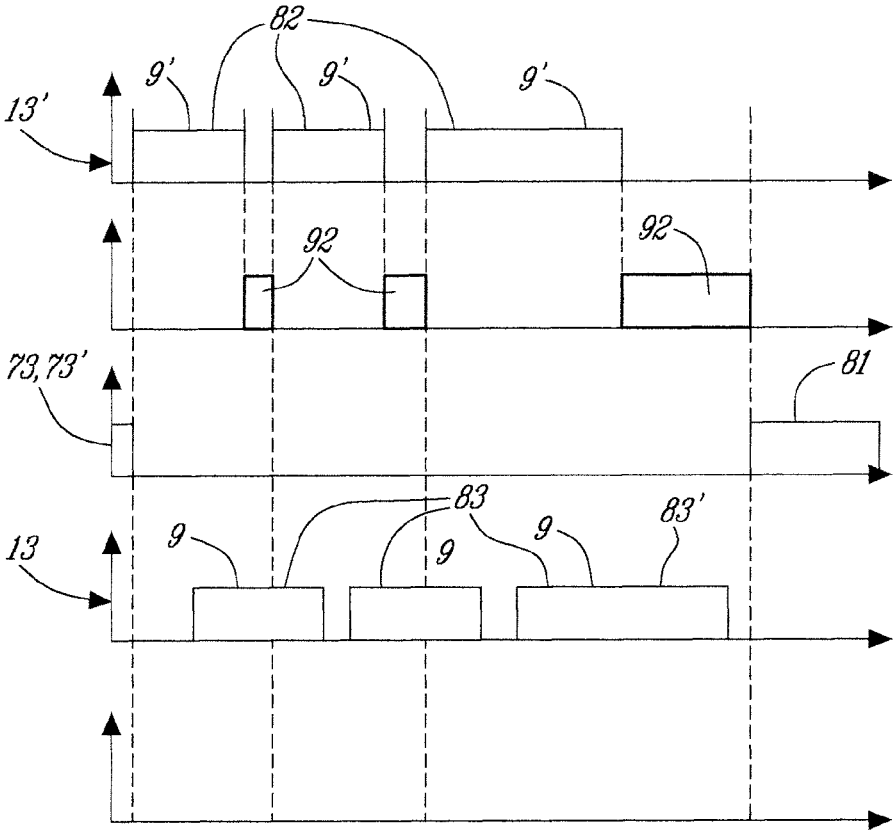

FIG. 24 depicts normal repetitive passage of people through the entrance gate system 10 of the present invention. As hereinshown when many people pass through the gate system one behind the other, the passage delay is too short to trigger the alarm system and such cannot be activated until the barrier arm 9 returns to its normal obstructing position. An alarm is triggered only if the barrier arm 9 is maintained open when the alarm is re-armed, as shown at 81, after the time delay 92. The blocks 82 illustrate the opening times of the barrier arm 9' of the outer assembly 13' whereas the blocks 83 show the conditions of the barrier arm 9 of the inner barrier arm assembly 13. As hereinshown the barrier arm 9 has re-closed, as illustrated by block 83' prior to the alarm system having been armed as illustrated by block 81 and no alarm is sound.

Figure 24A:
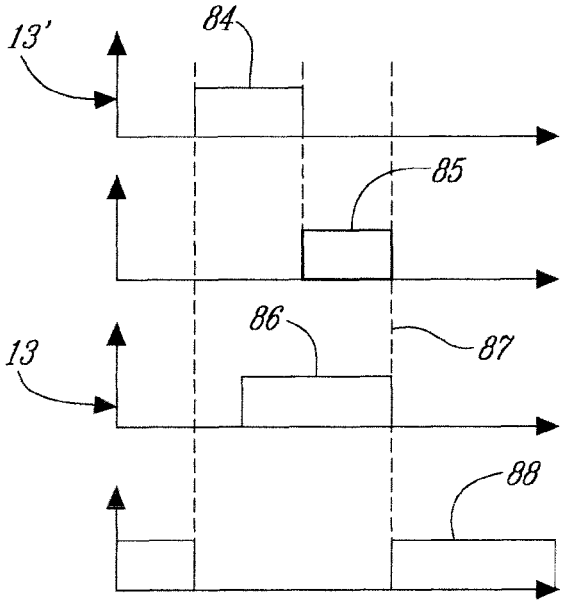
Figure 24B:
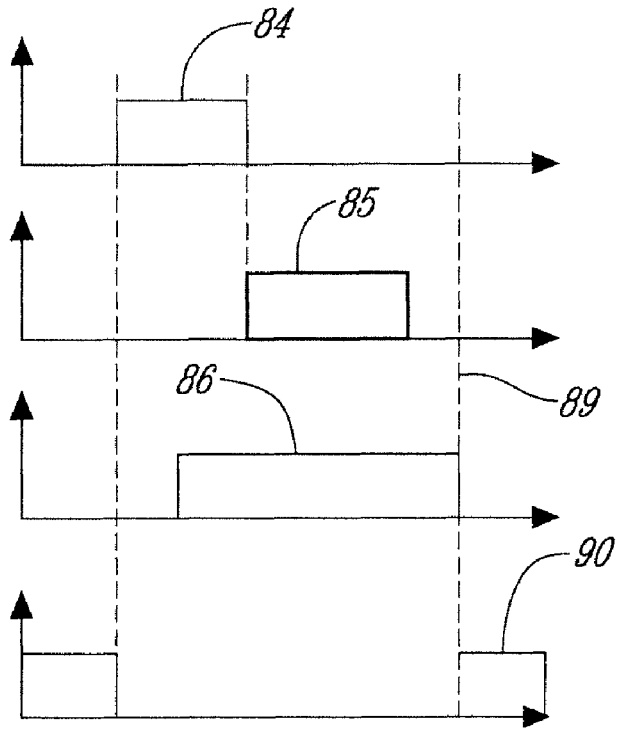

As shown in FIGS. 24A and 24B, when the barrier arm 9' of the outer barrier arm assembly 13' is opened the solenoid is actuated and the barrier arm 9 is free to pivot. When the barrier arm 9' re-closes as shown by block 84, it actuates the timer 66 as shown by block 85. This timer has no effect on the system if the barrier arms are open during the timer sequence as shown in FIGS. 24A and 24B. When the barrier arm 9 returns to its obstructing position, as shown by block 86, the controller engages the solenoid to lock the barrier arm 9 in its obstructing position at the time period 87. The system is then re-armed as illustrated by the block 88. If the barrier arm 9, block 86, remains open past the program delay, block 85, then an alarm condition will be established until the barrier arm 9 returns to its closed position as shown at time period 89. The system then becomes re-armed at this time period 89 as shown by block 90.

Figure 25:
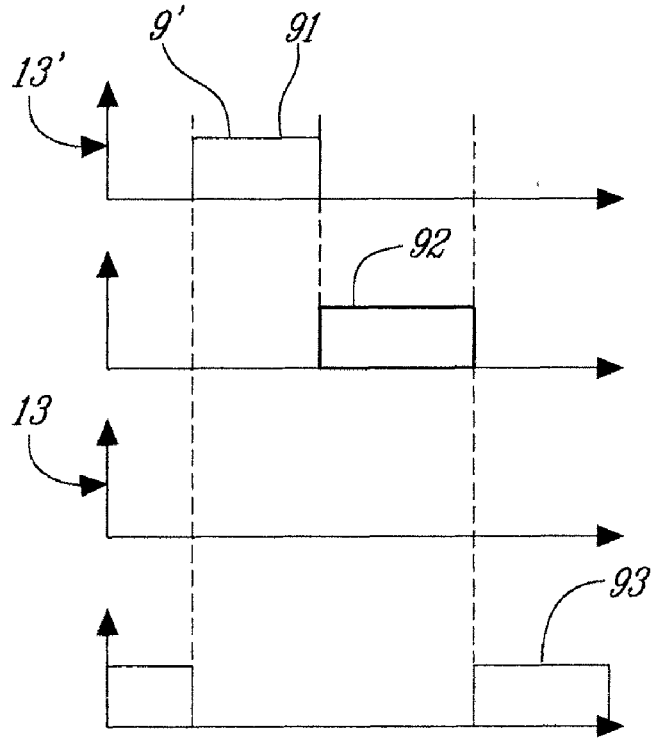

As shown in FIG. 25 it is possible that a person may start entering the passageway 14 and then decide not to enter as the barrier arm 9' is pushed inwardly in the direction of the passageway. This situation is illustrated by block 91 wherein the barrier arm 91 has been pushed towards an open position. This automatically disengages the latch of the solenoid permitting the barrier arm assembly 13 to pivot inwardly of the establishment in the direction of arrow 25, FIG. 1. However, the arm 9 is not moved. After the programmed time delay, as illustrated by block 92, the barrier arm 9, which has not been displaced, is simply re-engaged by the latch 31 of the solenoid 26 and the alarm circuits 73 and 73', illustrated by block 93 are re-armed.

When using optical light beams instead of the barrier arm 13', two light beams are used one near the bottom and one near the top of column 12'. Both beams have to be interfered within a set time delay to disconnect the latch of the barrier arm 13. The alarm system can be de-activated as previously described.

Figure 26:
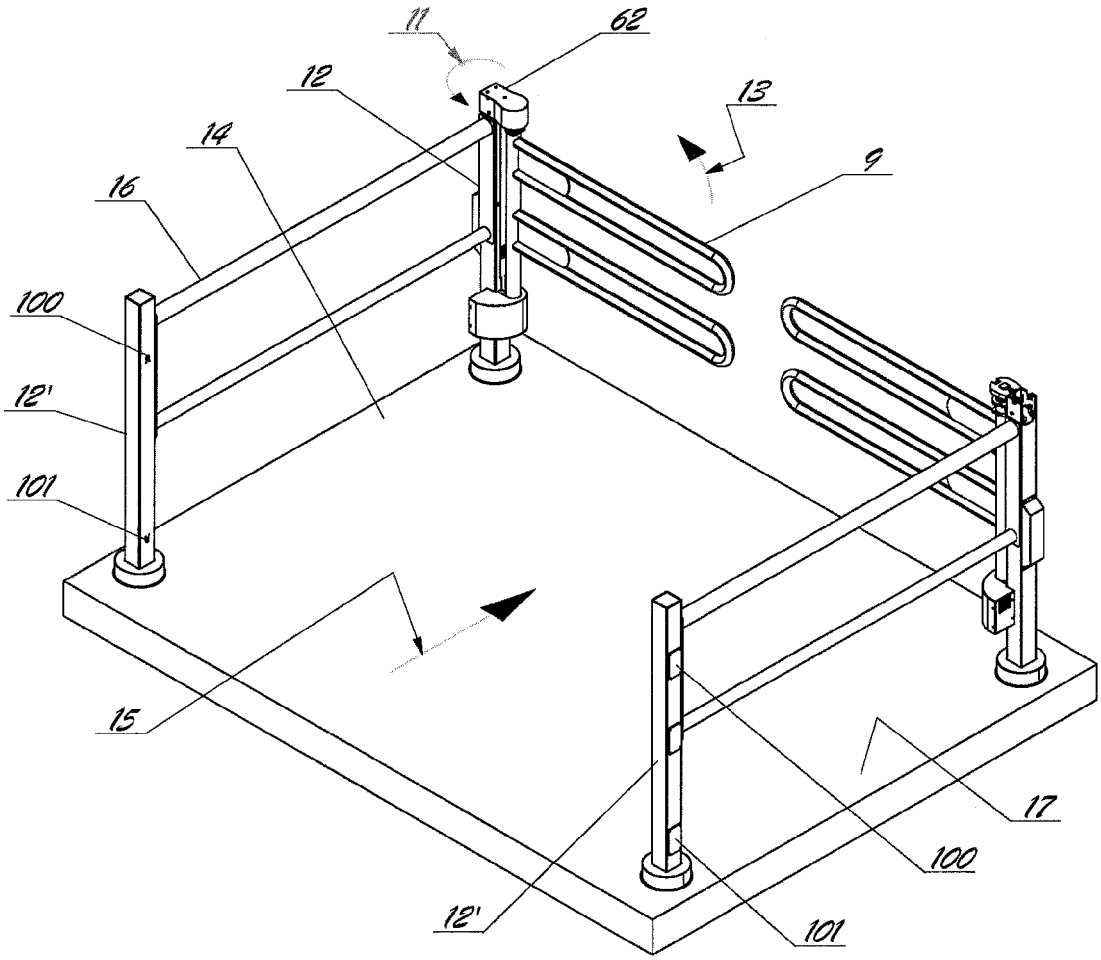
FIG. 26 is a perspective view showing the entrance gate system of the present invention comprised of a single barrier arm assembly.

It is within the ambit of the present invention to provide any obvious modifications of the embodiment described herein provided such modifications fall within the scope of the appended claims. As previously described it is envisaged that the entrance gate system of the present invention may be comprised of a single barrier arm assembly 13, as shown in FIG. 26, and that suitable sensing means may be provided at an entrance end of the passageway 14 to detect a person or a shopping cart or any object entering into the passageway and wherein such sensor would then automatically disengage the solenoid permitting the barrier arm assembly 13 to pivot.

Figure 27:
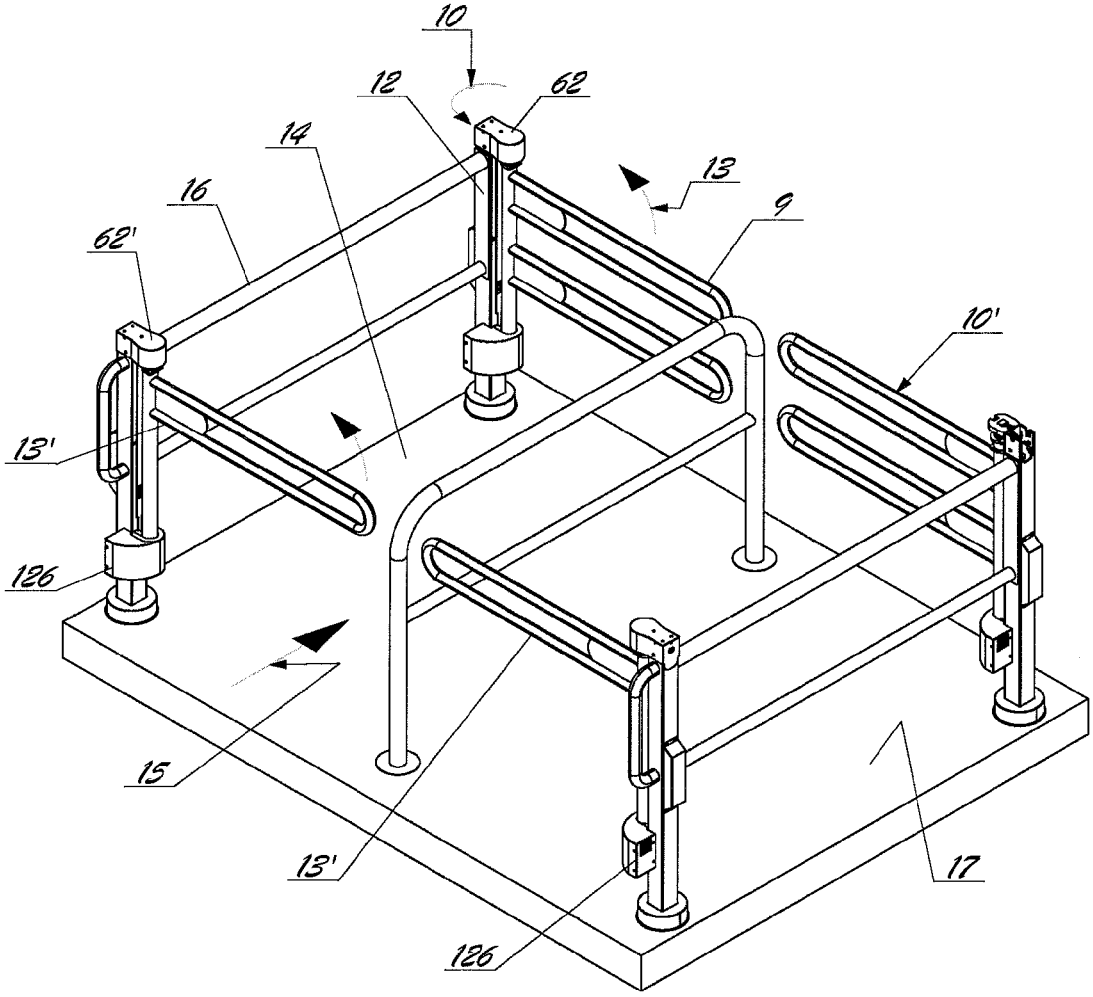
FIG. 27 is a perspective view showing a further embodiment wherein each barrier arm assembly is provided with an arresting latch.

FIG. 27 shows a further modification wherein the barrier arm assembly 13' is also provided with a solenoid assembly 126 identical in construction and operation as the solenoid 26 associated with the barrier arm assembly 13. The purpose of the solenoid assembly 126 is to latch the barrier arm assembly 13' after a set time delay after engaging the barrier arm assembly 13 preventing the exiting through the entrance gate system by holding the barrier arm assembly 13 in an open position.

Although FIG. 1 illustrates two entrance gate systems installed side-by-side, there could be more than two such entrance gate systems. It is also envisaged that such entrance gate systems could also be installed as an exit gate system wherein the outer support column 12', which would then be positioned inwardly of an establishment, may be provided with a detector 100 which detects active security protective devices placed on articles to prevent theft. The support column may also be equipped with an electronic motion detector 101. In the event that a person passes through the motion detector 101 with the security device disarmed, then the solenoid would be automatically disengaged permitting the person to freely exit the establishment. In the event that the sensing device detects an active security device then this would cause the solenoid 26 to remain engaged preventing the barrier arm assembly 13 to pivot and the alarm would be activated. A by-pass switch can be provided locally or remotely to retract the solenoid latch in the event of false alarms which occur when security devices are not properly deactivated at the cash registry.

We claim:

1. A controlled gate system comprising a barrier arm pivotably connected to a first fixed support, motion sensing detection means secured to a second fixed support spaced at a predetermined distance from said first fixed support and in alignment therewith to create a restricted passageway with said barrier arm resting at an obstructing position within said passageway, a barrier arm arresting member for arresting said barrier arm at said obstructing position, gate control means to position said arresting means at an engaged or disengaged position to arrest or release said barrier arm from pivotal movement, a barrier arm stopper member to restrict a distance of displacement of said barrier arm from said obstructing position to a non-obstructing position to permit passage through said passageway in a single direction when said barrier arm arresting member is at said disengaged position, said barrier arm being secured to a vertical tubular support member axially rotatably supported by said first fixed support, said barrier arm stopper member comprising at least one abutment member secured about said vertical tubular support member, said abutment member having two spaced-apart abutment surfaces, one of said abutment surfaces being disposed for abutment with an associated stopper element to restrict the axially rotatable displacement of said vertical tubular support member and said barrier arm secured thereto from said obstructing position to said non-obstructing position, the other abutment surface being disposed for abutment with an arresting latch of said barrier arm arresting member, said stopper element being secured to a displaceable support, said gate control means controlling an actuator secured to said displaceable support for displacing said associated stopper element to a non-engageable position clear of said spaced-apart abutment surfaces of said abutment member to permit free axial rotation of said vertical tubular support member in opposed directions from said obstructing position with said displaceable barrier arm arresting member positioned at said disengaged position by said gate control means.

2. A controlled gate system as claimed in claim 1 wherein said barrier arm is secured to a vertical tubular support member axially rotatably supported by said first fixed support, a barrier biasing mechanism associated with said vertical tubular member to automatically return said barrier arm to said obstructing position when displaced therefrom and released.

3. A controlled gate system as claimed in claim 2 wherein said vertical tubular member is a hollow tubular support post retained about a stationary vertical shaft, said barrier arm biasing mechanism comprising an upwardly angulated stationary ramp formation secured to said stationary vertical shaft and a ramp follower member secured inside said hollow tubular support post, said ramp follower member having a sloped formation adapted to sit on said stationary ramp formation, said barrier arm when displaced from said obstructing position towards said non-obstructing position by a pushing force, causing said ramp follower formation to be displaced in frictional contact with said upwardly angulated stationary ramp formation causing said vertical tubular support post and said barrier arm to rise as it is displaced from said obstructing position and to said non-obstructing position and to fall back to said obstructing position when said pushing force is released.

4. A controlled gate system as claimed in claim 2 wherein a further barrier arm is secured to a further vertical tubular support member axially rotatably supported on said second fixed support, said further barrier arm normally resting in an obstructing position within said passageway, said motion sensing detection means being a sensor detecting displacement of said further barrier arm from said obstructing position towards a non-obstructing position.

5. A controlled gate system as claimed in claim 4 wherein said further barrier arm is also provided with a barrier arm stopper member to restrict the arc of displacement of said further barrier arm from said obstructing position to said non-obstructing position in the direction of said barrier arm connected to said first fixed support, and a further one of said barrier arm biasing mechanism provided in said further vertical tubular support member.

6. A controlled gate system as claimed in claim 5 wherein an actuator is associated with said second fixed support to disengage said barrier arm stopper member to permit free axial rotation of said further barrier arm in opposed directions from said obstructing position.

7. A controlled gate system as claimed in claim 2 wherein said barrier arm arresting member is an arresting latch actuable by a solenoid, said barrier arm being secured to a vertical tubular support member axially rotatably supported between brackets secured to said first fixed support, said barrier arm stopper member being an abutment member secured to said vertical tubular support member and having an abutment surface for abutting said arresting latch when at said engaged position.

8. A controlled gate system as claimed in claim 7 wherein said note control means is a controller, said motion sensing detection means providing a signal to said to actuate said solenoid when a first condition is detected, said motion sensing detection means actuating a timer through said controller for a set predetermined period of time upon detection of a second condition, and an alarm circuit secured to said controller and actuable thereby after said predetermined period of time if said barrier arm has not returned to said obstructing position as detected by a sensor connected to said controller.

9. A controlled gate system as claimed in claim 8 wherein said motion sensing detection means is a second sensor, said second fixed support having a further barrier arm connected thereto, said second sensor sensing the position of said further barrier arm, said first condition being provided by the displacement of said further barrier arm from an obstructing position towards a non-obstructing position, said second condition being provided by the return of said further barrier arm to said obstructing position.

10. A controlled gate system as claimed in claim 9 wherein each said barrier arms is provided with stopper means to limit its displacement from said obstructing position to said non-obstructing position in a common direction of said passageway, said barrier arm stopper member being secured to actuators to engage and disengage same, and a central alarm connection and a key operated switch connected to said controller to actuate said actuator to cause disengagement of said barrier arm stopper member and to disengage said barrier arm arresting mechanism from said abutment members to cause said barrier arm and further barrier arm to freely pivot in either direction from their said obstructing position to permit passage from opposed direction in said passageway to enter or leave an establishment provided with said entrance gate system.

11. A controlled gate system as claimed in claim 2 wherein said barrier arm of said vertical tubular support member is provided with a respective one of said arresting means.

12. A controlled gate system as claimed in claim 1 wherein said gate control means is secured to an alarm system, said gate control means engaging said actuator to displace said stopper element to said non-engageable position upon reception of an alarm condition signal from said alarm system.

13. A controlled gate system as claimed in claim 1 wherein a key switch connection is connected to said gate control means to cause said gate control means to engage said actuator to displace said stopper element to said non-engageable position.

14. A controlled gate system as claimed in claim 1 wherein said at least one abutment member is an abutment ring secured about a lower end portion of said vertical tubular support member, and a further abutment ring secured about an upper end portion of said vertical tubular member, said further abutment ring having two spaced-apart abutment surfaces, said abutment surfaces of said further abutment ring being disposed for abutment with opposite arresting surface of an associated top stopper element.

15. A controlled gate system as claimed in claim 1 wherein said first fixed support is a vertical support column, said support column having a top and bottom support bracket between which said vertical tubular support member is axially rotatably supported, said displaceable support being a support rod secured to a connector attached to a displaceable arm of said actuator, said actuator being secured inside said support column, said support rod being guidingly retained against an outer surface of said support column by said connector captively displaceable in a guide slot of said support column.

16. A controlled gate system as claimed in claim 15 wherein said support rod is a flat support rod having a bottom narrow extension portion on a lower end of which said stopper element is secured, said bottom narrow extension portion being guidingly displaced through a top wall of said bottom support bracket to position said stopper element to said non-engageable position.

17. A controlled gate system as claimed in claim 16 wherein said stopper element is a metal block having opposed parallel vertical arresting surfaces, said support rod having a top narrow extension portion on which said top stopper element is secured, said top stopper element being guidingly displaced below said top support bracket to a non-engageable position from a further top one of said at least one abutment member.

18. A controlled gate system as claimed in claim 1 wherein said motion sensing detection means is an electronic motion detector.

19. A controlled gate system as claimed in claim 1 wherein there is further provided a security device detector in said second fixed support to detect the presence of active security devices placed in articles, said detector actuating said barrier arm arresting member to arrest said barrier arm of said obstructing position.

20. A controlled gate system comprising a barrier arm pivotably connected to a first fixed support, motion sensing detection means secured to a second fixed support spaced at a predetermined distance from said first fixed support and in alignment therewith to create a restricted passageway with said barrier arm resting at an obstructing position within said passageway, a barrier arm arresting member for arresting said barrier arm at said obstructing position, gate control means to position said arresting means at an engaged or disengaged position to arrest or release said barrier arm from pivotal movement, a barrier arm stopper member to restrict a distance of displacement of said barrier arm from said obstructing position to a non-obstructing position to permit passage through said passageway in a single direction when said barrier arm arresting member is at said disengaged position, said barrier arm being secured to a vertical tubular support member axially rotatably supported by said first fixed support, a barrier arm biasing mechanism associated with said vertical tubular member to automatically return said barrier arm to said obstructing position when displaced therefrom and released, said barrier arm arresting member being an arresting latch actuable by a solenoid, said barrier arm being secured to a vertical tubular support member axially rotatably supported between brackets secured to said first fixed support, said barrier arm stopper member being an abutment member secured to said vertical tubular support member and having an abutment surface for abutting said arresting latch when at said engaged position.

21. A controlled gate system as claimed in claim 20 wherein said gate control means is a controller, said motion sensing detection means providing a signal to said to actuate said solenoid when a first condition is detected, said motion sensing detection means actuating a timer through said controller for a set predetermined period of time upon detection of a second condition, and an alarm circuit secured to said controller and actuable thereby after said predetermined period of time if said barrier arm has not returned to said obstructing position as detected by a sensor connected to said controller.

22. A controlled gate system as claimed in claim 21 wherein said motion sensing detection means is a second sensor, said second fixed support having a further barrier arm connected thereto, said second sensor sensing the position of said further barrier arm, said first condition being provided by the displacement of said further barrier arm from an obstructing position towards a non-obstructing position, said second condition being provided by the return of said further barrier arm to said obstructing position.

23. A controlled gate system as claimed in claim 22 wherein each said barrier arms is provided with stopper means to limit its displacement from said obstructing position to said non-obstructing position in a common direction of said passageway, said barrier arm stopper member being secured to actuators to engage and disengage same, and a central alarm connection and a key operated switch connected to said controller to actuate said actuator to cause disengagement of said barrier arm stopper member and to disengage said barrier arm arresting member from said abutment members to cause said barrier arm and further barrier arm to freely pivot in either direction from their said obstructing position to permit passage from opposed direction in said passageway to enter or leave an establishment provided with said entrance gate system.

* * * * *